US011125515B2

(12) United States Patent
Vehr

(10) Patent No.: US 11,125,515 B2
(45) Date of Patent: Sep. 21, 2021

(54) LOW-MASS BOLT CARRIER

(71) Applicant: Velocity Precision Engineering, LLC, Phoenix, AZ (US)

(72) Inventor: Thomas Vehr, Phoenix, AZ (US)

( * ) Notice: Subject to any disclaimer, the term of this patent is extended or adjusted under 35 U.S.C. 154(b) by 0 days.

(21) Appl. No.: 16/733,967

(22) Filed: Jan. 3, 2020

(65) Prior Publication Data

US 2021/0148663 A1 May 20, 2021

Related U.S. Application Data

(60) Provisional application No. 62/794,559, filed on Jan. 19, 2019.

(51) Int. Cl.
*F41A 3/26* (2006.01)
*F41A 3/66* (2006.01)

(52) U.S. Cl.
CPC . *F41A 3/66* (2013.01); *F41A 3/26* (2013.01)

(58) Field of Classification Search
CPC ..... F41A 3/26
USPC ..... 89/180
See application file for complete search history.

(56) References Cited

U.S. PATENT DOCUMENTS 6,418,655 B1 * 7/2002 Kay ..... F41A 3/46 42/70.08
7,930,968 B2 * 4/2011 Giefing ..... F41A 3/26 89/185

OTHER PUBLICATIONS

Fail Zero Lightweight Bolt Carrier Group (YouTube video; https://www.youtube.com/watch?v=ydLOJgLZvqw) (Year: 2018).*

* cited by examiner

*Primary Examiner* — Reginald S Tillman, Jr.
(74) *Attorney, Agent, or Firm* — Jason Bergeron

(57) ABSTRACT

The present convention comprises a new structure for bolt carriers intended for use in the AR-15 weapon platform. This improved low-mass bolt carrier boasts significantly lower mass than the state of the art while maintaining greater strength than other low-mass bolt carriers using different structures. The geometric cutouts along the lateral faces of the bolt carrier form truss-like structures that increase the ratio of the bolt carrier's strength to its mass and enable high-performance tuning of the weapon, notably with less recoil.

20 Claims, 2 Drawing Sheets

LOW-MASS BOLT CARRIER

FIELD OF INVENTION

This patent relates generally to bolt carriers for semi-automatic rifles, and more particularly, to the bolt carrier group for a rifle in the AR-15 pattern.

BACKGROUND OF INVENTION

The AR-15 and its variants is one of the most popular semiautomatic rifles on the civilian market today. A major design feature of the AR-15 is recoil reduction. Automatic and semi-automatic weapons use the gases released by firing a round to push the bolt back and chamber the next round in the weapon's magazine; the AR-15 design philosophy minimized the motion of these gases and the weapon's moving parts along any axis except the one parallel to the gun barrel. In this way, the AR-15 is imbued with very gentle recoil relative to other contemporary semiautomatic rifles, and the weapon's manageable recoil remains a strong selling point to this day. But recoil is still an issue even with these advancements. Like all firearms, the AR-15 discharge a bullet using a controlled explosive powder, typically gunpowder. When the bullet is launched with the exploding gunpowder, recoil is the effect.

Recoil is a universal experience and concern in the world of shooting this firearm or any. The force of the exploding powder charge propels the bullet through and out of the gun barrel, while Newtonian physics dictates that the explosion must push the firearm backward with equal force. The problem with small arms, or any other firearm not mounted to a hard-point of some sort, is that the firearm will exerts the same force on the body of the gun's user, pushing the body back and requiring that the user exert effort to compensate for recoil. The difficulties and effects of recoil become noticeably more important as the user attempts to fire each round after the first; imperfect recoil compensation on the part of the user can cause the gun barrel to rise, or the user's body to shift, or the user's hand to move the weapon to a direction slightly off from the desired target. The issue is the user must then either spend more time reacquiring a target, or accept a decrease in accuracy.

Lawful use of a firearm always benefits from greater accuracy. More than just shots fired while hunting or in self-defense, lawful use also comprises active military operations, law enforcement, security, recreational target shooting and civilian marksmanship competitions. In all such lawful uses, the safest shot is one directed at the lawful target. Any decrease in accuracy caused by recoil decreases safety to the user and to every third party in the vicinity, while reducing the chance of that any successive shots will find their proper target. Stronger effective recoil or "felt recoil" also makes the weapons less accessible to users with lower body mass or with less physical strength. Any innovation which increases accuracy thus increases safety to the user and to bystanders. Likewise, any innovation which reduces felt recoil increases accessibility to smaller or weaker users.

The present invention is designed to overcome such deficiencies.

SUMMARY OF INVENTION

The present invention is an improvement of the low-mass bolt carrier intended for use within an AR-15 rifle or similar style firearm. The low-mass bolt carrier consists of a forward distal end and an aft distal end, said forward distal end and aft distal end being joined by a plurality of truss structure, each truss structure further comprising a series of geometric shaped cutouts.

BRIEF DESCRIPTION OF THE DRAWINGS

The accompanying drawings illustrate complete preferred embodiments of the present invention according to the best modes presently devised for the practical application of the principles thereof, and in which.

Figures 1A, 1B:
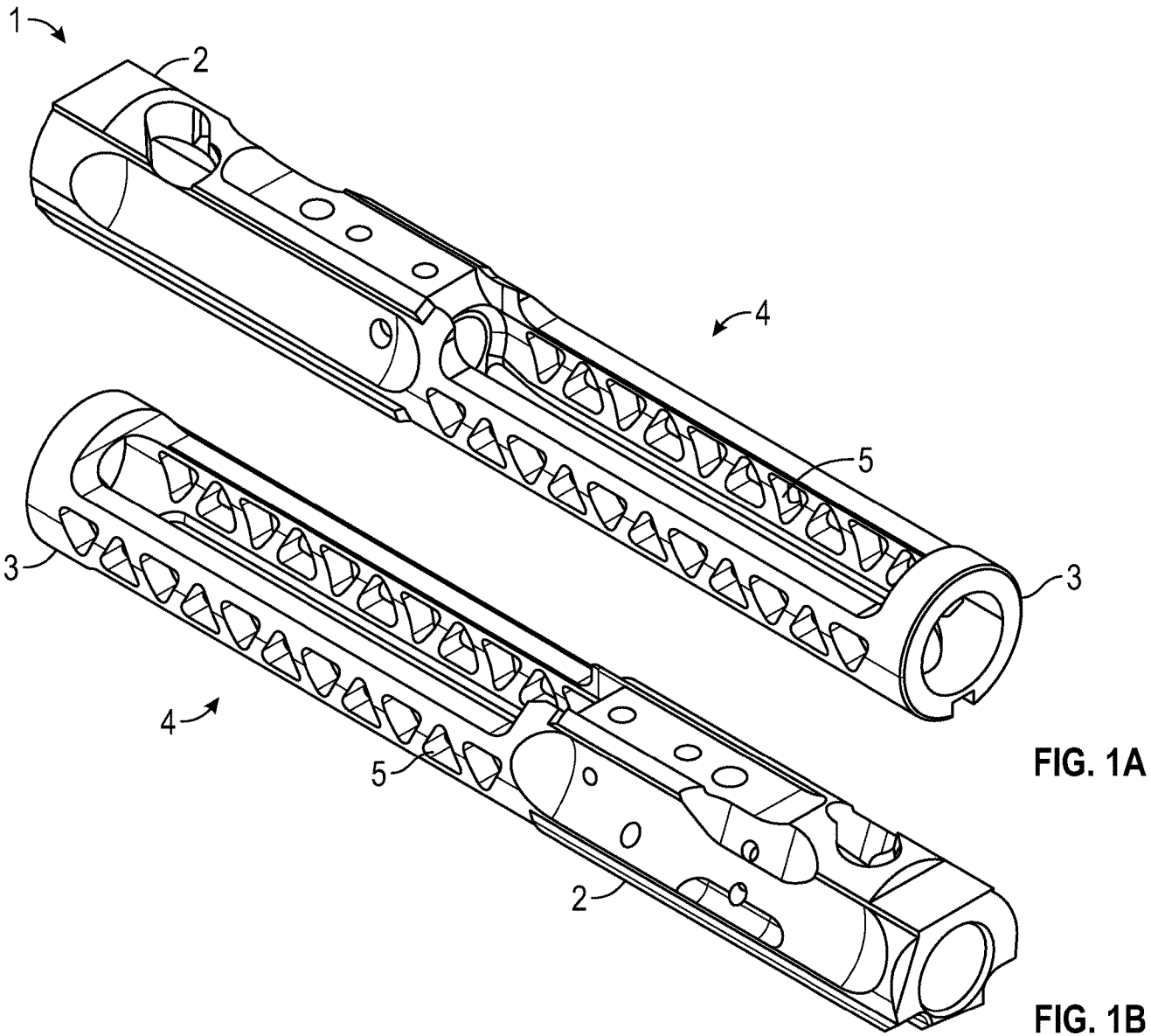
FIG. 1A depicts a perspective view of the preferred embodiment of the present invention.
FIG. 1B depicts a perspective view of the preferred embodiment of the present invention.

And note that the preferred embodiment of the invention is design for use in an AR-15 rifle or variant thereof. The dimensions and design notes on the attached images are reflective of that preferred embodiment. Different embodiments incorporating the innovations presented herein will have dimensions matching those of the bolt carrier for different firearms.

DETAILED DESCRIPTION OF PREFERRED EMBODIMENTS

The present invention is presented in its preferred embodiment unless otherwise noted; the description is meant to be illustrative and the claims to encompass alternative embodiments. Additional embodiments will be apparent to one skilled in the art in light of the disclosure presented herein.

The AR-15 bolt carrier group or "BCG" is well-known in the art. The BCG comprises the bolt carrier and all other components attached thereto, and it is the part of the weapon which moves back and forth as the weapon is fired, releasing empty casings and chambering successive rounds. The variant presented herein is a novel advance on what is known as the "low-mass bolt carrier." A low-mass bolt carrier, properly installed, reduces the felt recoil of a rifle as shown herein.

Two primary ways of reducing the mass of a bolt carrier are known in the art: first, by making the bolt carrier out of a lighter metal; or second, by removing portions of the bolt carrier body, usually by cutting out unnecessary parts of the whole assembly. Both methods may be utilized at once. Steel is a common metal used to assemble bolt carriers. While is steel is durable, it is a metal with a greater mass than other metals. Even when steel bolts are reduced in mass by thinning techniques, they still carry that greater mass.

Aluminum bolt carriers are lighter than steel ones, but not as strong, so removing pieces from an aluminum bolt carrier creates greater risk of structural failure compared to identical changes to a steel bolt carrier. Titanium bolt carriers are lighter than steel and are quite strong, but tend to have greater friction against other parts unless coated in a friction-reducing agent which may degrade or wear off. It is important that the low-mass bolt carriers be improved to reduce weight, which will help to minimize recoil without compromising needed durability. Standard practice in the gunsmithing industry is to either use thinner lengths of metal to join the forward and aft ends of a bolt carrier, or to mill long slots into those lengths of metal to remove mass. However, both practices significantly weaken the bolt carrier, which makes the weapon more fragile in proportion to its decrease in mass. What is needed in the art is a way to remove material in such a way as to preserve as much structural integrity in the bolt carrier as possible, allowing the weapon to reduce felt recoil without compromising structural integrity at the very epicenter of the chemical and mechanical forces that make the weapon operate.

A typical example of a steel bolt carrier in the art masses approximately 8.6 ounces. Of the low mass bolt carriers in the art, the lightest steel bolt carrier known to the inventor masses approximately 6.3 ounces. Working steel prototypes of the present invention have a mass of approximately 5.7 ounces and can have a functional range of 6.5 ounces to 5.0 ounces in total mass. If the mass is lower than this range, use of the low-mass bolt carrier will cause a deterioration in structural integrity of the low-mass bolt carrier and cause the bolt carrier to warp and/or break. The present invention represents an innovative step from previous work in the art, not only due to the way in which the presently-disclosed innovations reduce the mass of a bolt carrier to a greater degree than any previously seen in the art, but additionally because the present invention retains a safer level of structural durability relative to its very low mass.

Referring to FIG. 1A and FIG. 1B, the illustration shows an embodiment of the present invention, which is an improved low-mass bolt carrier (1), intended for use within an AR-15 rifle or similar firearm. The improved low-mass bolt carrier (1) further comprises a forward distal end (2) and an aft distal end (3), the forward distal end (2) and aft distal end (3) being joined by a plurality of truss structure (4) as a linking segment, each truss structure (4) further comprising a series of geometric shaped cutouts (5). In the preferred embodiment, the geometric shaped cutouts (5) should be triangular, but are not limited to that shape, and can be various other geometric shapes that prove to be sturdy, reliable, and less prone to ware or decay of structural integrity.

A variety of thinning techniques have been utilized to remove mass, but it is shown that such techniques do not provide durability over time. Long, rectangular cutouts are done along the parallel length of the linking segment of the aft and forward end of other types of bolt carriers to try to remove mass. Half-circles have been milled out of the top and bottom portion of the linking segments of other bolt carriers. Full circles have been milled out of the aft end of different bolt carriers. And, the aft and forward ends of additional bolt carriers have thinner linking segments to reduce mass.

Referring back to FIGS. 1A and 1B of the preferred embodiment, the geometric shaped cutouts (5) are preferably milled into the improved low-mass bolt carrier (1) using a CNC Mill but other milling methods in the art can be used. While it is possible to create the low-mass bolt carrier (1) by forging, casting, 3-D printing or other means known in the art, milling is preferred. These geometric shaped cutouts (5), not known in the prior art of bolt carrier design, remove significant amounts of mass from the improved low-mass bolt carrier (1) when compared to other examples from the prior art.

Figure 2:
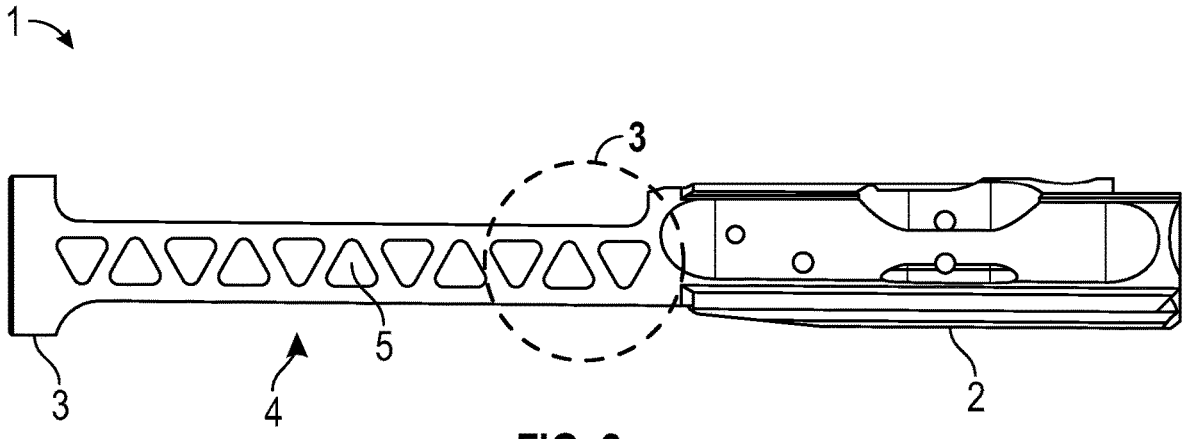
FIG. 2 depicts a side view of the preferred embodiment of the present invention.

Referring to FIG. 2, the schematics of the improved low-mass bolt carrier (1) show additional details of the novel disclosure. In the preferred embodiment, all dimensions are listed as inches. In the preferred embodiment, triangular cutouts (5) are milled into the truss structure (4). These triangular cutouts (5) should be more preferably equilateral triangles. Such equilateral triangles have three bases (sides) that would be in a ratio of 1:1:1. As equilateral triangles, these cutout (5) should preferably have three internal vertexes (angles) with ratios of 6°:60°:60°. The orthocenter of such equilateral triangles is inside the center of the cutout (5) providing a central focal point of each altitude that runs directly through each angle and creating a centrally located median. In the preferred embodiment, these equilateral triangle cutouts (5) can have a functional range of 0.268+/−0.010 for each side, a range of 0.260-0.280 for the height of the triangle cutout from the base to the opposite apex, and a 0.125+/−0.020 distance between the apex/base of the triangular cutout (5) and outer-edge of the length side of the truss structure (4) depending on placement of such cutouts (5) on the truss structure (4). In the preferred embodiment, the space between each adjacent triangle cutout (7) base running substantially parallel should be 0.082+/−0.003.

Figure 3:
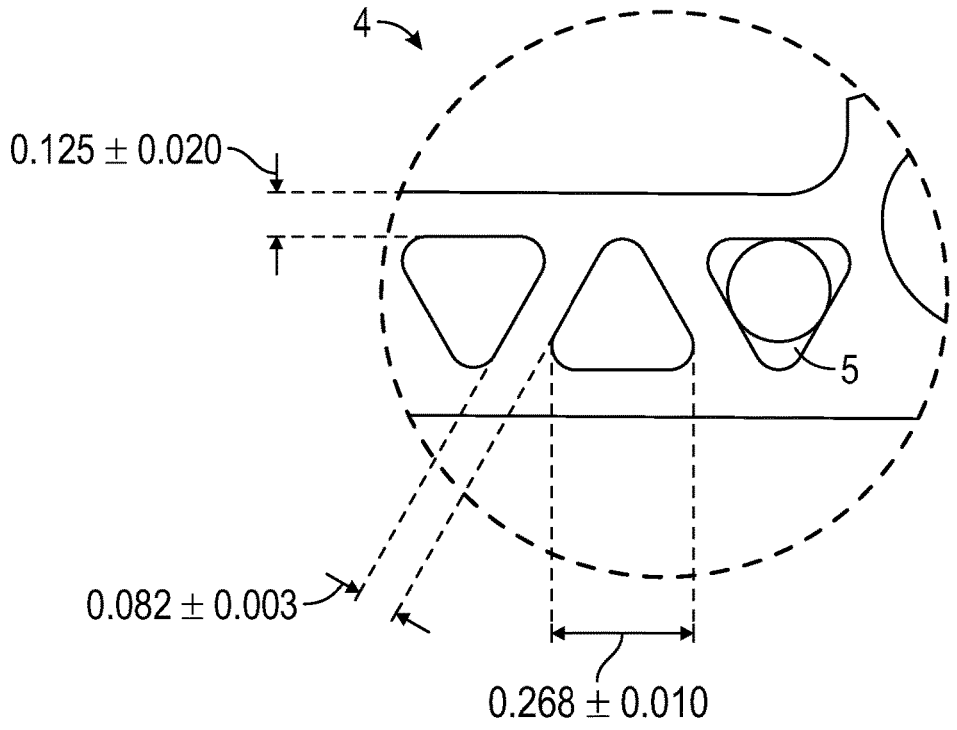
FIG. 3 depicts an enlarged portion of the side view of the preferred embodiment of the present invention.

The dimensional ranges of the improved low-mass bolt carrier's front distal end (2), aft distal end (3), truss structure (4), and geometric shaped cutouts (5), are preferably in the functional range of 6.660+/−0.005 in overall length of the entire low-mass bolt carrier, 0.918+/−0.001 in diameter at the aft distal end (3), 3.380+/−0.010 for the truss structure (4) top length, 3.650+/−0.010 for the truss structure (4) bottom length, plus the pertinent dimensions of the entire low-mass bolt carrier (1) as found in the schematics of FIG. 2 and FIG. 3, and should be comprehended by a person skilled in the art as there is a limited amount of space in the AR-15 chamber (or similar firearm) for a bolt carrier to work properly. If the low mass bold carrier (1) is too long, or too short it will not fit snuggly in the chamber. If the low mass bolt carrier (1) is too wide or narrow, again it will not fit properly either. And if the low mass bolt carrier (1) is too heavy or light, it could inhibit the chambering action from taking place properly. All these factors will play a role in having a bold carrier that in non-functioning. Thus, the improved low-mass bolt carrier (1) disclosed here will contain many of the same ranges of dimensions, sizes and shapes as traditional bolt carriers used in the art preferably in a functional ranges as noted above, but with a noticeable advancement of reducing mass.

The structure of the improved low-mass bolt carrier (1) takes advantage of the physics of recoil. When a bullet is chambered in this firearm, the bullet casing portion of the projectile rests in a bolt assembly that slides into the forward distal end (2) of the low-mass bolt carrier (1). When a user fires a bullet, the firing pin in the aft distal end (3) of the low-mass bolt carrier (1) strikes and ignites a gunpowder load within a bullet casing. This detonates the gunpowder and creates a chemical explosion. The chemical explosion, confined within the bullet casing, generates expanding gases which force the bullet forward through a gun barrel. At the same time, the chemical explosion pushes backward against the gun with an equal force, said force being transferred to the rifle via the improved low-mass bolt carrier (1). The force generated at the time of the chemical explosion is known as "primary recoil".

After the primary recoil, the bullet passes through the gun barrel, propelled by the expanding gasses from within the bullet casing; as the expanding gasses escape the barrel of the rifle, they exert additional force on the weapon, known as "secondary recoil". At nearly the same instant the AR-15 rifle or similar firearm, using a direct impingement system, will direct a portion of the expanding gases through a tube parallel to the gun barrel against a gas key, said gas key being fixed to the improved low-mass bolt carrier (1). The expanding gases redirected through the gas tube create pressure against the gas key until the improved low-mass bolt carrier (1) is pushed backward against a spring, at the same time ejecting the bullet casing and those expanding gases which were redirected to the gas key. Conservation of momentum dictates that the momentum cannot simply stop but must be transferred into the user through the action of recoil. After the expanding gases have been ejected from the AR-15 or similar rifle, the spring returns the improved low-mass bolt carrier (1) to its forward position, in the processing chambering a second bullet if available.

The rearward motion of the improved low-mass bolt carrier (1) creates its own felt recoil against the user, as does the action of the spring returning the improved low-mass bolt carrier (1) to its forward position. The recoil caused by the backward and forward motion of the improved low-mass bolt carrier (1) are collectively referred to herein as "BCG recoil". BCG recoil is the effect that is most directly reduced by the current design. The improved low-mass bolt carrier (1) can be pushed fully to the aft position by a smaller impulse from the gas tube compared to a heavier bolt carrier because less gas is needed to be directed to the bolt carrier to move it since less gas is required to move a bolt carrier with a lower mass in the aft position. The improved low-mass bolt carrier (1) may likewise be fully returned to its forward position by a less powerful spring, while still performing the necessary mechanical functions of ejecting spent cartridges and chambering new cartridges at the desired speed. The reduction in the mass of the improved low-mass bolt carrier (1) over a heavier bolt carrier is the feature that enables this improved performance.

The forces of primary recoil, secondary recoil, and BCG recoil, in conjunction with the motion of the improved low-mass bolt carrier (1), place great demands on the durability of the improved low-mass bolt carrier (1). The truss structure (4) meet this need in a manner improved over the prior art by virtue of the novel technique of mass-reduction. A typical bolt carrier comprises two lengths of metal joining the forward distal end and aft distal ends of the bolt carrier; in its preferred embodiment, the improved low-mass bolt carrier (1) also comprises two lengths of metal joining the forward distal (2) and aft distal ends (3) of the bolt carrier. However, where a typical bolt carrier simply comprises two solid lengths of metal and a typical low-mass bolt carrier comprises two lengths of metal with known cutouts or thinning techniques, the present invention comprises truss structure (4) that serve as the linking segment of the forward distal end (2) and aft distal end (3) of the improve low-mass bolt carrier (1), replacing the typical solid or thinned lengths of metal that connects the forward and aft ends of other bolt carriers. The truss structure (4) further comprises a series of preferably triangular cutouts but can be other geometric shapes that prove beneficial to the durability of the improved low-mass bolt carrier FIG. 3 of the preferred embodiment shows the detailed schematics of making the triangular cutouts. The triangular cutouts take advantage of the nature of alternating two-force members of compression and tension to improve the overall strength-to-mass ratio of the truss structures (4). This "two-force member" allows for a structural component where force is applied to exert that force on only two points along the whole length of the truss structure (4) so the net force on each location of stress is equal, opposite and collinear. While some parts of the truss structure (4) are put under exertion by multiple forces when in use, other parts are not under these stresses. This leaves the exertion of the force distributed throughout the truss structure (4), which has a resilient truss design. Since only two-force members are applied, the members are organized so that the assembly as a whole behaves as a single body. Because of the rigidity of the truss structure (4), the low-mass bolt carrier (1) has more resilience against the forces of torque, compression, expansion and tensile.

The truss structure (4) shows alternating strut segments oriented substantially diagonally to the longer dimensions of the first and second trusses. Such a truss structure (4) can have a range as noted in the detailed schematic illustration. Such an alternating strut segment is possible with a coordinating geometric shaped cutout (5). Such a shape would preferably be the equilateral triangle.

The cutouts in the shape of the equilateral triangle can utilize the ratio of equal bases on all three sides to form the best complementary laterally adjacent segments. Isosceles triangles with two equal sides (bases) and scalene triangles with no equal base sides can be alternate triangle cutouts and can have complementary laterally adjacent segments. Other shapes that can utilize a complementary laterally adjacent segment include trapezoids, pentagons or other multisided polygons. Other geometric shaped cutouts (5) can be multisided shapes that could also prove to have structural integrity if the complementary laterally adjacent segments for a truss structure (4). These other geometric shapes cutouts (5) could consist of hexagons, heptagons, octagons and any other wide range of multisided polygons that will allow rigidity and structural integrity to the truss structure (4). With more sides comes the prospect of a curved geometric shape that could provide the complementary laterally adjacent segments of the truss structure (4). In the preferred embodiment, FIG. 3 will show that the truss structure (4) will be milled with the equilateral triangles as the geometric cutout shape (5).

In the preferred embodiment, the geometric cutouts (5) should be series of triangular cutouts comprises a plurality of those triangular cutouts, alternatingly oriented upward or downward. Preferably, the plurality of triangle cutouts are equilateral in shape. Every equilateral triangles base (whether above or below the center of each triangle) should run parallel to the length of the truss structure (4). The space between each triangle base and the top and bottom truss structures (4) length should preferable be in the functional range of 0.125+/−0.020. And each apex (above and below each triangle center) should also have a functional range of 0.125+/−0.020 of space to the truss structures (4) outer length edge. In the preferred embodiment, the diagonal space between each alternating equilateral triangle base that runs to the length should be in the functional range of 0.082+/−0.003, but can alternate giving placement of each cutout, the size of each cutout and the particular shape of each cutout.

The geometric shaped triangle cutouts (5) would alternate along the length of the truss structure (4) with the apex (interior top angle) of one triangle parallel to the base of the second triangle. Thus, the base and apex of each alternating triangle would be parallel to the length of the linking segment truss structure (4) of the forward distal end (2) and aft distal end (3) of the whole low-mass bolt carrier. Alternate embodiments can have the geometric cutouts (5) as triangles that have an apex higher or lower than the next alternate base of its parallel cutout.

Each two-force member undergoes compression and tension during the operation of the improved low-mass bolt carrier, but the design efficiently transfers forces from the forward distal end (2) to the aft distal end (3) without concentrating an unsafe quantity of force at a single point of potential failure. In the preferred embodiment, the truss structure (4) further comprise an exterior face having a rounded characteristic to fit within an existing AR-15 or similar rifle. These truss structure (4) may comprise a greater or lesser number of triangular cutouts (5) in order to fine-tune the ratio of mass to durability in different embodiments of the improved low-mass bolt carrier (1), limited by the length of the truss structure (4) in a given embodiment; likewise, the exact size of the triangular cutouts (5) may vary from one embodiment to the next in order to fine-tune the ratio of mass to durability, limited by the height of the truss structure (4). And as noted supra, the preferred embodiment has triangular cutouts (5) to take advantage of that geometric shape, but other geometric shapes (5) may be used if proven durable and resilient to structural failure of the improved low-mass bolt carrier Referring back to FIG. 2 of the preferred embodiment, it is the truss structures (4) of the improved low-mass bolt carrier (1) that will further comprise a plurality geometric shaped cutouts (5) as triangular cutouts. The plurality of triangular cutouts (5) of this preferred embodiment will continue to have alternating orientation and similar spacing to those on the truss structure (4). Again, alternate geometric shapes can be cutout if proven durable and create structural integrity.

In the preferred embodiment presented in the FIG. 2, the improved low-mass bolt carrier (1) will incorporate multiple geometric cutouts (5) as preferably triangular cutouts on each truss structure (4). These triangular cutouts as the geometric shapes (5) that will preferably run parallel to the truss structure (4) and will be preferably located in a parallel line and spaced equally from one another along those truss structure (4). Referring back to FIG. 3, this shows a more detailed illustration of the triangular cutouts (5) and the schematics to follow. Again, since there is only so much variation with regard to the dimensions of an AR-15 or variant bolt carrier, the measurements of the cutouts and spaces between will be calculated by a person skilled in the art. If the cutouts have spacing or placement issues, the structural integrity of the improved low mass bolt carrier (1) could be affected, causing issues with the function of the low-mass bolt carrier (1).

In its preferred embodiment, the improved low-mass bolt carrier comprises 8620 steel and it is in this steel prototype embodiment that the present low-mass bolt carrier (1) has a mass of 5.7 ounces with a functional range of 5.0 to 6.5 ounces. The improved low-mass bolt carrier (1) has a lower weight than any prior art known to the inventor. Other embodiments are possible, notably those comprising titanium, aluminum, or any other strong, non-corrosive metals or materials that are durable and resilient to structurally degradation with use. In the preferred embodiment, the forward distal end (2), aft distal end (3), and truss structure (4) form a unitary body; said forward distal end (2), aft distal end (3), and truss structure (4) are intended as differentiations on features of a single body and not as separate components fixed together.

Any of the types of metal used in the art of gunsmithing can be used, including various steel, titanium, aluminum, or any other strong, non-corrosive metals or materials. But 8620 steel is preferred. The technique of creating triangular cutouts (5) functions on all metals known in the art. The preferred embodiment of the present invention is preferably subject to a process of industrial milling as the method to create the triangular cutouts, additional triangular cutouts or other geometric shapes (5) that provide structural integrity to the low-mass bolt carrier (1).

There are a variety of bolt carrier platforms manufactured for use in the AR-15 and its variants. The thinning technique of reducing mass to create a low-mass bolt carrier (1) as described herein will work on all the variety of bolt carrier platforms that are manufactured for use in the AR-15 and its variants. And a variety of multi-caliber bolts can fit into the front distal end (2) of this improved low-mass bolt carrier (1).

The invention claimed is:

1. An improved low-mass bolt carrier comprising:

two truss structures, with an anterior portion and posterior portion, the two truss structures each comprising a length of durable material and a plurality of geometric shaped cutouts, each one of the plurality of geometric shaped cutouts is oriented opposite to the geometric shaped cutout immediately adjacent thereto on the length of the truss structures;

a forward distal end;

an aft distal end;

wherein said truss structures extends substantially parallel between the forward distal end and the aft distal end, allowing the truss structures, forward distal end, and aft distal end to form a unitary body.

2. The improved low-mass bolt carrier of claim 1, wherein each of the plurality of geometric shaped cutouts is positioned opposite to one of the plurality of geometric shaped cutouts on the second truss structure forming a parallel and perpendicular orientation of the plurality of geometric shaped cutouts along the truss structures.

3. The improved low-mass bolt carrier of claim 1, further comprising one or more additional truss structures.

4. The improved low-mass bolt carrier of claim 1, wherein the geometric shape has a curved shape with side segments, the adjacent side segments of two immediately adjacent cutouts are substantially curved parallel.

5. The improved low-mass bolt carrier of claim 4, wherein the geometric shaped cutouts combine curved and linear elements.

6. The improved low-mass bolt carrier of claim 1, wherein the geometric shape cutouts are multisided polygons, the side segments of two immediately adjacent cutouts are substantially linear parallel.

7. The improved low-mass bolt carrier of claim 1, wherein the geometric shape cutouts are multisided polygons, the side segments of two immediately adjacent cutouts are substantially linear parallel.

8. The improved low-mass bolt carrier of claim 1, wherein the geometric shape cutouts are triangles, the side segments of two immediately adjacent cutouts are substantially linear parallel.

9. A method of manufacturing an improved low-mass bolt carrier as described herein, comprising the steps of:

machining a plurality of equilateral triangle shaped cutouts further includes the step of placing the plurality of equilateral triangle shaped cutouts in substantially parallel lines on each truss structure, wherein the spacing between each equilateral triangle shaped cutout and each additional equilateral triangle shaped cutout is identical for all equilateral triangle shaped cutouts and all additional equilateral triangle shaped cutouts along the parallel length of the truss structures.

10. The method of manufacturing an improved low-mass bolt carrier of claim 9, comprising the steps of machining a plurality of geometric shaped cutouts further includes the step of placing each of the plurality of geometric shaped cutouts perpendicularly opposition one of the plurality of geometric shaped cutouts on the opposite truss structure.

11. The method of manufacturing an improved low-mass bolt carrier of claim 9, each of the plurality of geometric shaped cutouts is a multisided polygon.

12. The method of manufacturing an improved low-mass bolt carrier of claim 9, in which the resulting placement of the geometric shaped cutouts creates a truss structure.

13. The method of manufacturing an improved low-mass bolt carrier of claim 9 comprising the step of having each one of the plurality of geometric shaped cutouts is oriented opposite to the geometric shaped cutout immediately adjacent thereto;

a forward distal end;

an aft distal end;

wherein said truss structures connect the forward distal end and the aft distal end, allowing the truss structures, forward distal end, and aft distal end to form a unitary body.

14. The method of manufacturing an improved low-mass bolt carrier of claim 9, further comprising one or more additional truss structures.

15. The method of manufacturing an improved low-mass bolt carrier of claim 9, wherein the geometric shaped cutouts each have side segments and the adjacent side segments between two immediately adjacent cutouts are substantially parallel.

16. The method of manufacturing an improved low-mass bolt carrier of claim 9, wherein the geometric shape has a curve shape and the adjacent side segments of two immediately adjacent cutouts that are substantially curved parallel.

17. The method of manufacturing an improved low-mass bolt carrier of claim 9, wherein the geometric shape has a combined curved and linear side segment and the side segments of two immediately adjacent cutouts are substantially linear parallel.

18. The method of manufacturing an improved low-mass bolt carrier of claim 9, wherein the geometric shape is a multisided polygon shape with the side segments of two immediately adjacent cutouts are substantially linear parallel.

19. The method of manufacturing an improved low-mass bolt carrier of claim 9, wherein the geometric shape is a multisided polygon, the side segments of two immediately adjacent cutouts are substantially linear parallel side.

20. The method of manufacturing an improved low-mass bolt carrier of claim 9, wherein the geometric shape has a triangle shape and the side segments of two immediately adjacent cutouts are substantially linear parallel.

* * * * *